US006672386B2

(12) United States Patent
Krueger et al.

(10) Patent No.: US 6,672,386 B2
(45) Date of Patent: Jan. 6, 2004

(54) METHOD FOR IN-SITU ANALYSIS OF FORMATION PARAMETERS

(75) Inventors: Sven Krueger, Celle (DE); Eick Niemeyer, Hannover (DE); Matthias Meister, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/164,970

(22) Filed: Jun. 6, 2002

(65) Prior Publication Data

US 2003/0226663 A1 Dec. 11, 2003

(51) Int. Cl.[7] ..... E21B 49/10; E21B 49/08

(52) U.S. Cl. ..... 166/252.5; 166/250.02; 166/264; 166/100; 73/152.52; 73/152.05; 73/152.24

(58) Field of Search ..... 175/50, 59; 166/250.01, 166/252.5, 100, 250.02, 264; 73/152.52, 152.05, 152.24, 152.29, 152.31, 152.55

(56) References Cited

U.S. PATENT DOCUMENTS 4,423,625 A * 1/1984 Bostic et al. ..... 73/152.52
4,752,882 A * 6/1988 Givens ..... 702/13
4,773,264 A * 9/1988 Herron ..... 73/152.05
4,890,487 A * 1/1990 Dussan V. et al. ..... 73/152.05
5,056,595 A * 10/1991 Desbrandes ..... 166/100
5,233,866 A 8/1993 Desbrandes ..... 73/155
5,303,582 A * 4/1994 Miska ..... 73/152.21
5,377,755 A 1/1995 Michaels et al. ..... 166/264
5,587,525 A * 12/1996 Shwe et al. ..... 73/152.52
5,703,286 A * 12/1997 Proett et al. ..... 73/152.05
5,708,204 A 1/1998 Kasap ..... 73/152.52
5,803,186 A 9/1998 Berger et al. ..... 175/50
6,157,893 A * 12/2000 Berger et al. ..... 702/9
6,343,507 B1 * 2/2002 Felling et al. ..... 73/152.19
6,568,487 B2 * 5/2003 Meister et al. ..... 175/50
6,585,045 B2 * 7/2003 Lee et al. ..... 166/252.5

OTHER PUBLICATIONS

"Robust and Simple Graphical Solution for Wireline Formation: Combined Drawdown and Buildup Analyses", Authors: Ehrem Kasap, Kun Huang, Than Shwe & Dan Georgi; Presented at the 1996 WSPE Annual Technical Conference and Exhibition; Denver, CO; Oct. 6–9, 1996; SPE36525; 343–357.

"Enhanced Wireline Formation Tests in Low–Permeability Formations: Quality control Through Formation Rate Analysis", Authors: Jaedong Lee & John Michaels; Society of Petroleum Engineers, SPE 60293.

* cited by examiner

*Primary Examiner*—David Bagnell
*Assistant Examiner*—T. Shane Bomar
(74) *Attorney, Agent, or Firm*—Madan, Mossman & Sriram, P.C.

(57) ABSTRACT

A method of performing a formation rate analysis from pressure and formation flow rate data. Pressure and flow rate data are measured as fluid is withdrawn from a formation. Variable system volume is accounted for. The pressure and flow rate data are correlated using a multiple linear regression technique. Time derivative terms related to pressure and flow rate are smoothed using a summation technique, thereby providing better correlations than using the time derivatives directly. Formation parameters comprising formation permeability, formation pressure, and fluid compressibility may be determined from the correlation.

16 Claims, 6 Drawing Sheets

METHOD FOR IN-SITU ANALYSIS OF FORMATION PARAMETERS

BACKGROUND OF THE INVENTION

1. Field of the Invention

This invention relates to the testing of underground formations or reservoirs. More particularly, this invention relates to a method for determining properties of the earth formation by interpreting fluid pressure and flow rate measurements.

2. Description of the Related Art

To obtain hydrocarbons such as oil and gas, boreholes are drilled by rotating a drill bit attached at a drill string end. A large proportion of the current drilling activity involves directional drilling, i.e., drilling deviated and horizontal boreholes to increase the hydrocarbon production and/or to withdraw additional hydrocarbons from the earth's formations. Modern directional drilling systems generally employ a drill string having a bottomhole assembly (BHA) and a drill bit at an end thereof that is rotated by a drill motor (mud motor) and/or by rotating the drill string. A number of downhole devices placed in close proximity to the drill bit measure certain downhole operating parameters associated with the drill string. Such devices typically include sensors for measuring downhole temperature and pressure, azimuth and inclination measuring devices and a resistivity-measuring device to determine the presence of hydrocarbons and water. Additional down-hole instruments, known as logging-while-drilling (LWD) tools, are frequently attached to the drill string to determine the formation geology and formation fluid conditions during the drilling operations.

Drilling fluid (commonly known as the "mud" or "drilling mud") is pumped into the drill pipe to rotate the drill motor, provide lubrication to various members of the drill string including the drill bit and to remove cuttings produced by the drill bit. The drill pipe is rotated by a prime mover, such as a motor, to facilitate directional drilling and to drill vertical boreholes. The drill bit is typically coupled to a bearing assembly having a drive shaft, which in turn rotates the drill bit attached thereto. Radial and axial bearings in the bearing assembly provide support to the radial and axial forces of the drill bit.

Boreholes are usually drilled along predetermined paths and the drilling of a typical borehole proceeds through various formations. The drilling operator typically controls the surface-controlled drilling parameters, such as the weight on bit, drilling fluid flow through the drill pipe, the drill string rotational speed and the density and viscosity of the drilling fluid to optimize the drilling operations. The downhole operating conditions continually change and the operator must react to such changes and adjust the surface-controlled parameters to optimize the drilling operations. For drilling a borehole in a virgin region, the operator typically has seismic survey plots which provide a macro picture of the subsurface formations and a pre-planned borehole path. For drilling multiple boreholes in the same formation, the operator also has information about the previously drilled boreholes in the same formation.

Typically, the information provided to the operator during drilling includes borehole pressure and temperature and drilling parameters, such as Weight-On-Bit (WOB), rotational speed of the drill bit and/or the drill string, and the drilling fluid flow rate. In some cases, the drilling operator also is provided selected information about the bottom hole assembly condition (parameters), such as torque, mud motor differential pressure, torque, bit bounce and whirl etc.

Downhole sensor data are typically processed downhole to some extent and telemetered uphole by sending a signal through the drill string, or by mud-pulse telemetry which is transmitting pressure pulses through the circulating drilling fluid. Although mud-pulse telemetry is more commonly used, such a system is capable of transmitting only a few (1–4) bits of information per second. Due to such a low transmission rate, the trend in the industry has been to attempt to process greater amounts of data downhole and transmit selected computed results or "answers" uphole for use by the driller for controlling the drilling operations.

Commercial development of hydrocarbon fields requires significant amounts of capital. Before field development begins, operators desire to have as much data as possible in order to evaluate the reservoir for commercial viability. Despite the advances in data acquisition during drilling using the MWD systems, it is often necessary to conduct further testing of the hydrocarbon reservoirs in order to obtain additional data. Therefore, after the well has been drilled, the hydrocarbon zones are often tested with other test equipment.

One type of post-drilling test involves producing fluid from the reservoir, shutting-in he well, collecting samples with a probe or dual packers, reducing pressure in a test volume and allowing the pressure to build-up to a static level. This sequence may be repeated several times at several different depths or point within a single reservoir and/or at several different reservoirs within a given borehole. One of the important aspects of the data collected during such a test is the pressure build-up information gathered after drawing the pressure down. From these data, information can be derived as to permeability, and size of the reservoir. Further, actual samples of the reservoir fluid must be obtained, and these samples must be tested to gather Pressure-Volume-Temperature data and fluid properties such as density, viscosity and composition.

In order to perform these important tests, some systems require retrieval of the drill string from the borehole. Thereafter, a different tool, designed for the testing, is run into the borehole. A wireline is often used to lower the test tool into the borehole. The test tool sometimes utilizes packers for isolating the reservoir. Numerous communication devices have been designed which provide for manipulation of the test assembly, or alternatively, provide for data transmission from the test assembly. Some of those designs include mud-pulse telemetry to or from a downhole microprocessor located within, or associated with the test assembly. Alternatively, a wire line can be lowered from the surface, into a landing receptacle located within a test assembly, establishing electrical signal communication between the surface and the test assembly. Regardless of the type of test equipment currently used, and regardless of the type of communication system used, the amount of time and money required for retrieving the drill string and running a second test rig into the hole is significant. Further, if the hole is highly deviated, a wire line can not be used to perform the testing, because the test tool may not enter the hole deep enough to reach the desired formation.

A more recent system is disclosed in U.S. Pat. No. 5,803,186 to Berger et al. The '186 patent provides a MWD system that includes use of pressure and resistivity sensors with the MWD system, to allow for real time data transmission of those measurements. The '186 device allows obtaining static pressures, pressure build-ups, and pressure draw-downs with the work string, such as a drill string, in place. Also, computation of permeability and other reservoir parameters based on the pressure measurements can be accomplished without pulling the drill string.

The system described in the '186 patent decreases the time required to take a test when compared to using a wireline. However, the '186 patent does not provide an apparatus for improved efficiency when wireline applications are desirable. A pressure gradient test is one such test wherein multiple pressure tests are taken as a wireline conveys a test apparatus downward through a borehole. The purpose of the test is to determine fluid density in-situ and the interface or contact points between gas, oil and water when these fluids are present in a single reservoir.

Another apparatus and method for measuring formation pressure and permeability is described in U.S. Pat. No. 5,233,866 issued to Robert Desbrandes, hereinafter the '866 patent. FIG. 1 is a reproduction of a figure from the '866 patent that shows a drawdown test method for determining formation pressure and permeability.

Referring to FIG. 1, the method includes reducing pressure in a flow line that is in fluid communication with a borehole wall. In Step 2, a piston is used to increase the flow line volume thereby decreasing the flow line pressure. In other tools, such as that described by Michaels et al in U.S. Pat. No. 5,377,755, incorporated herein by reference, a pump is used to draw fluid from the formation. The rate of pressure decrease is such that formation fluid entering the flow line combines with fluid leaving the flow line to create a substantially linear pressure decrease. A "best straight line fit" is used to define a straight-line reference for a predetermined acceptable deviation determination. The acceptable deviation shown is 2σ from the straight line. Once the straight-line reference is determined, the volume increase is maintained at a steady rate. At a time $t_1$, the pressure exceeds the 2σ limit and it is assumed that the flow line pressure being below the formation pressure causes the deviation. At $t_1$, the drawdown is discontinued and the pressure is allowed to stabilize in Step 3. At $t_2$, another drawdown cycle is started which may include using a new straight-line reference. The drawdown cycle is repeated until the flow line stabilizes at a pressure twice. Step 5 starts at $t_4$ and shows a final drawdown cycle for determining permeability of the formation. Step 5 ends at $t_5$ when the flow line pressure builds up to the borehole pressure Pm. With the flow line pressure equalized to the borehole pressure, the chance of sticking the tool is reduced. The tool can then be moved to a new test location or removed from the borehole.

A drawback of the '866 patent is that the time required for testing is too long due to stabilization time during the "mini-buildup cycles." In the case of a low permeability formation, the stabilization may take from tens of minutes to even days before stabilization occurs. One or more cycles following the first cycle only compound the time problem.

Whether using wireline or MWD, the formation pressure and permeability measurement systems discussed above measure pressure by drawing down the pressure of a portion of the borehole to a point below the expected formation pressure in one step to a predetermined point well below the expected formation pressure or continuing the drawdown at an established rate until the formation fluid entering the tool stabilizes the tool pressure. Then the pressure is allowed to rise and stabilize by stopping the drawdown. The drawdown cycle may be repeated to ensure a valid formation pressure is being measured, and in some cases lost or corrupted data require retest. This is a time-consuming measurement process.

One method for measuring permeability and other parameters of a formation and fluid from such data is described in U.S. Pat. No. 5,708,204 issued to Ekrem Kasap, and assigned Western Atlas, hereinafter the '204 patent and incorporated herein by reference. The '204 patent describes a fluid flow rate analysis method for wireline formation testing tools, from which near-wellbore permeability, formation pressure (p*), and formation fluid compressibility are readily determined. When a formation rate analysis is performed using a piston to draw formation fluid, both pressure and piston displacement measurements as a function of time are analyzed using a multiple linear regression technique having the general form:

$$y=a_0+a_1 \cdot x_1+a_2 \cdot x_2 \tag{1}$$

Commonly, the multiple linear regression is applied to the differential equation below in the following way:

$$\overset{y}{\overline{p(t)}} = \overset{a_0}{\overline{p^*}} - \overset{a_1}{\overline{\frac{\eta}{kG_0 r_i}\frac{1}{C}}} \cdot \overset{x_1}{\overline{V \cdot \frac{dp}{dt}}} - \overset{a_2}{\overline{\frac{\eta}{kG_0 r_i} \cdot A_{piston}}} \cdot \overset{x_2}{\overline{\frac{dx}{dt}}} \tag{2}$$

(see Nomenclature section for symbol definitions)

The pressure p(t) in the draw down unit and the displacement x(t) of the draw down piston are available as a time series of measured data. From these data, the derivatives dp/dt and dx/dt are calculated for use in Eq. (2). Note that for systems using a pump to draw formation fluid, the term $A_{piston} \cdot dx/dt$ is replaced by q, the volumetric flow rate of the pump.

With common multiple linear regression techniques, the coefficients $a_0$, $a_1$ and $a_2$ can be determined, which is the output of the formation rate analysis, as these coefficients contain all the desired information about the formation. The derivatives dp/dt and dx/dt are calculated numerically from the measured p(t) and x(t) data that is, in most cases, contaminated by noise. This noise represents a problem that deteriorates the result of the analysis substantially.

The methods of the present invention overcome the foregoing disadvantages of the prior art by providing a novel method for performing a multiple linear regression analysis of the measured data to provide a substantially more accurate correlation of the data.

SUMMARY OF THE INVENTION

The present invention contemplates a method for determining at least one parameter of interest of a formation surrounding a borehole. The method comprises conveying a tool into a borehole, where the borehole traverses a subterranean formation containing formation fluid under pressure. A probe is extended from the tool to the formation establishing hydraulic communication between the formation and a volume of a chamber in the tool. Fluid is withdrawn from the formation by increasing the volume of the chamber in the tool with a volume control device. Data sets are measured of a pressure of the fluid and the volume of the chamber as a function of time. Time derivatives are calculated of the measured pressure and the measured volume for each data set. A set of equations is generated comprising a multiple linear equation for each data set relating the measured pressure to a first term related to the time derivative of pressure and a second term related to the time derivative of volume. For each data set, the measured pressure comprises the corresponding measured pressure added to the sum of measured pressure of all preceding data sets; the first term comprises the corresponding time derivative of pressure added to the sum of time derivatives of pressure of all preceding data sets; and the second term comprises the corresponding time derivative of volume added to the sum of time derivatives of volume of all preceding data sets. A multiple linear regression is performed on the set of equations determining an intercept term, a first slope term associated with the first term, and a second slope term associated with the second term. Formation permeability, formation pressure, and fluid compressibility can be determined from the correlated data.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DESCRIPTION OF PREFERRED EMBODIMENTS

Figure 2:
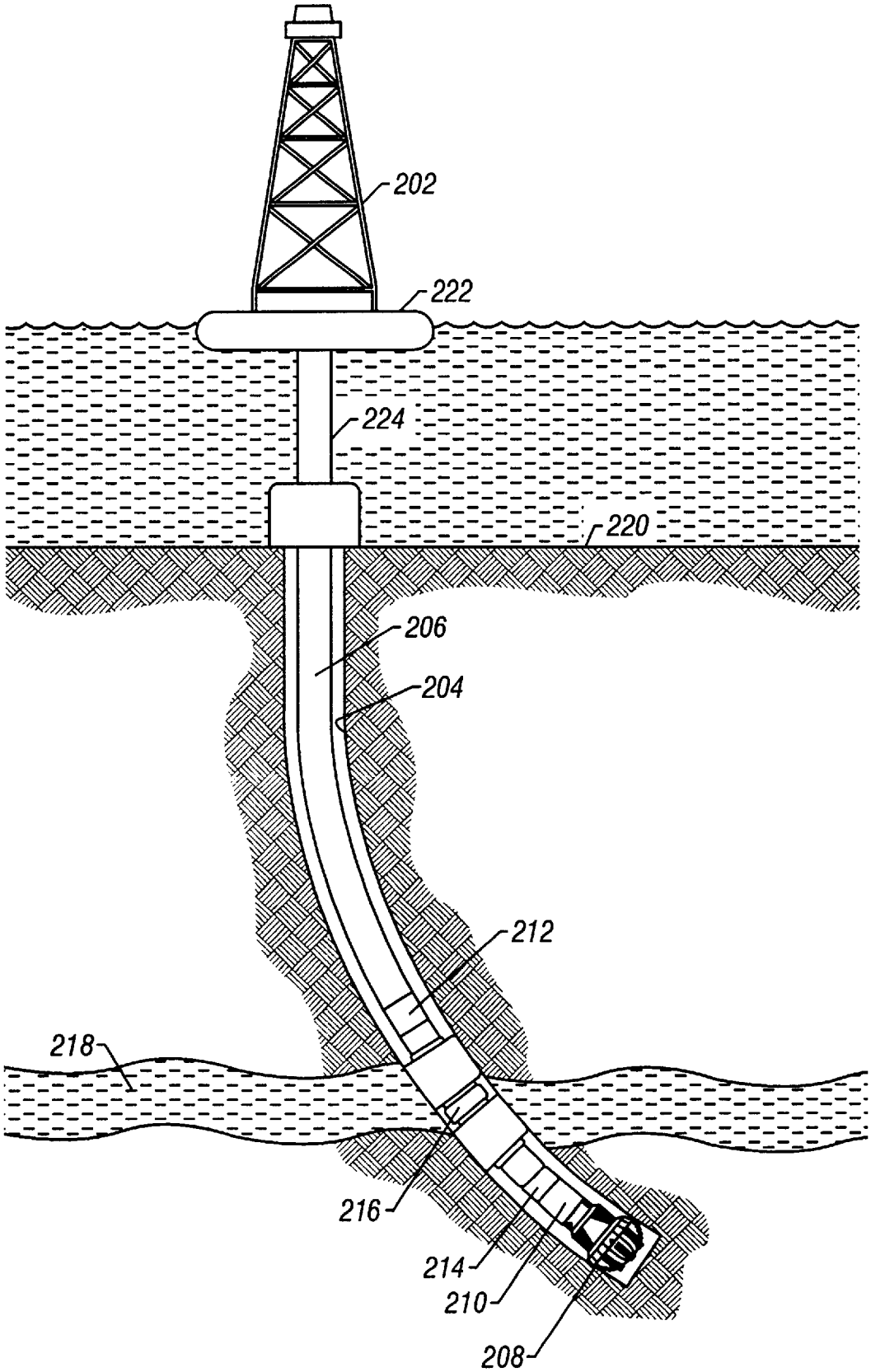
FIG. 2 is an elevation view of an offshore drilling system according to one embodiment of the present invention.

FIG. 2 is a drilling apparatus according to one embodiment of the present invention. A typical drilling rig 202 with a borehole 204 extending therefrom is illustrated, as is well understood by those of ordinary skill in the art. The drilling rig 202 has a work string 206, which in the embodiment shown is a drill string. The drill string 206 has attached thereto a drill bit 208 for drilling the borehole 204. The present invention is also useful in other types of work strings, and it is useful with a wireline, jointed tubing, coiled tubing, or other small diameter work string such as snubbing pipe. The drilling rig 202 is shown positioned on a drilling ship 222 with a riser 224 extending from the drilling ship 222 to the sea floor 220. However, any drilling rig configuration such as a land-based rig may be adapted to implement the present invention.

If applicable, the drill string 206 can have a downhole drill motor 210. Incorporated in the drill string 206 above the drill bit 208 is a typical testing unit, which can have at least one sensor 214 to sense downhole characteristics of the borehole, the bit, and the reservoir, with such sensors being well known in the art. A useful application of the sensor 214 is to determine direction, azimuth and orientation of the drill string 206 using an accelerometer or similar sensor. The BHA also contains the formation test apparatus 216 of the present invention, which will be described in greater detail hereinafter. A telemetry system 212 is located in a suitable location on the work string 206 such as above the test apparatus 216. The telemetry system 212 is used for command and data communication between the surface and the test apparatus 216.

Figure 3:
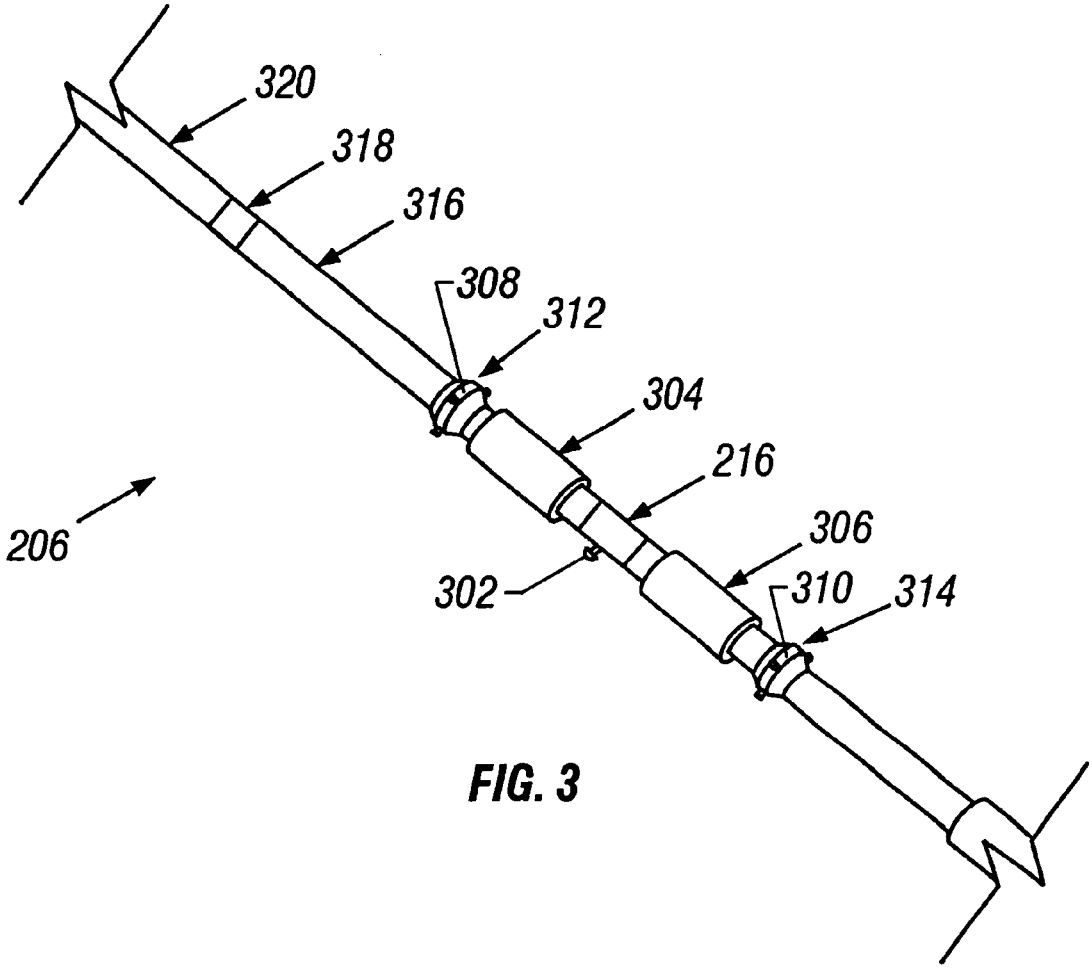
FIG. 3 shows a portion of drill string incorporating the present invention.

FIG. 3 is a section of drill string 206 incorporating the present invention. The tool section is preferably located in a BHA close to the drill bit (not shown). The tool includes communication unit 318 and power supply 320 for two-way communication to the surface and supplying power to the downhole components. In the preferred embodiment, the tool requires a signal from the surface only for test initiation. A downhole controller and processor (not shown) carry out all subsequent control. The power supply may be a generator driven by a mud motor (not shown) or it may be any other suitable power source. Also included are multiple stabilizers 308 and 310 for stabilizing the tool section of the drill string 206 and packers 304 and 306 for sealing a portion of the annulus. A circulation valve disposed preferably above the upper packer 304 is used to allow continued circulation of drilling mud above the packers 304 and 306 while rotation of the drill bit is stopped. A separate vent or equalization valve (not shown) is used to vent fluid from the test volume between the packers 304 and 306 to the upper annulus. This venting reduces the test volume pressure, which is required for a drawdown test. It is also contemplated that the pressure between the packers 304 and 306 could be reduced by drawing fluid into the system or venting fluid to the lower annulus, but in any case some method of increasing the volume of the intermediate annulus to decrease the pressure will be required.

In one embodiment of the present invention an extendable pad-sealing element 302 for engaging the well, also called borehole, wall 204 (FIG. 2) is disposed between the packers 304 and 306 on the test apparatus 216. The pad-sealing element 302 could be used without the packers 304 and 306, because a sufficient seal with the well wall can be maintained with the pad 302 alone. If packers 304 and 306 are not used, a counterforce is required so pad 302 can maintain sealing engagement with the wall of the borehole 204. The seal creates a test volume at the pad seal and extending only within the toot to the pump rather than also using the volume between packer elements.

One way to ensure the seal is maintained is to ensure greater stability of the drill string 206. Selectively extendable gripper elements 312 and 314 could be incorporated into the drill string 206 to anchor the drill string 206 during the test. The grippers 312 and 314 are shown incorporated into the stabilizers 308 and 310 in this embodiment. The grippers 312 and 314, which would have a roughened end surface for engaging the well wall, would protect soft components such as the pad-sealing element 302 and packers 304 and 306 from damage due to tool movement. The grippers 312 would be especially desirable in offshore systems such as the one shown in FIG. 2, because movement caused by heave can cause premature wear out of sealing components.

Figure 4:
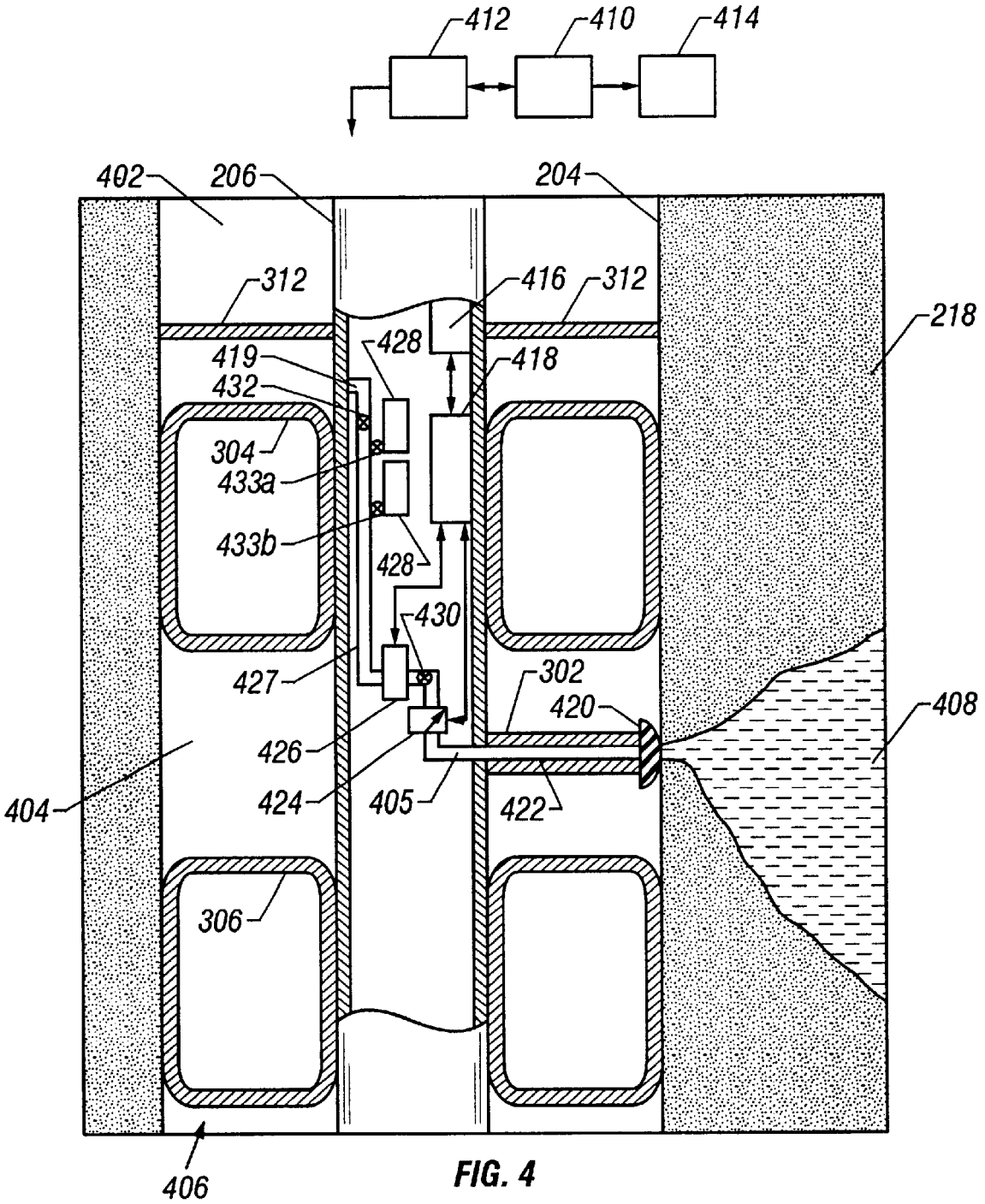
FIG. 4 is a system schematic of the present invention.

FIG. 4 shows the tool of FIG. 3 schematically with internal downhole and surface components. Selectively extendable gripper elements 312 engage the borehole wall 204 to anchor the drill string 206. Packer elements 304 and 306 well known in the art extend to engage the borehole wall 204. The extended packers separate the well annulus into three sections, an upper annulus 402, an intermediate annulus 404 and a lower annulus 406. The sealed annular section (or simply sealed section) 404 is adjacent a formation 218. Mounted on the drill string 206 and extendable into the sealed section 404 is the selectively extendable pad sealing element 302. A fluid line providing fluid communication between pristine formation fluid 408 and tool sensors such as pressure sensor 424 is shown extending through the pad member 302 to provide a port 420 in the sealed annulus 404. The preferable configuration to ensure pristine fluid is tested or sampled is to have packers 304 and 306 sealingly urged against the wall 204, and to have a sealed relationship between the wall and extendable element 302. Reducing the pressure in sealed section 404 prior to engaging the pad 302 will initiate fluid flow from the formation into the sealed section 404. With formation flowing when the extendable element 302 engages the wall, the port 420 extending through the pad 320 will be exposed to pristine fluid 408. Control of the orientation of the extendable element 302 is highly desirable when drilling deviated or horizontal wells. The preferred orientation is toward an upper portion of the borehole wall. A sensor 214, such as an accelerometer, can be used to sense the orientation of the extendable element 302. The extendable element can then be oriented to the desired direction using methods and not shown components well known in the art such as directional drilling with a bend-sub. For example, the drilling apparatus may include a drill string 206 rotated by a surface rotary drive (not shown). A downhole mud motor (see FIG. 2 at 210) may be used to independently rotate the drill bit. The drill string can thus be rotated until the extendable element is oriented to the desired direction as indicated by the sensor 214. The surface rotary drive is halted to stop rotation of the drill string 206 during a test, while rotation of the drill bit may be continued using the mud motor of desired.

A downhole controller 418 preferably controls the test. The controller 418 is connected to at least one system volume control device (pump) 426. The pump 426 is a preferably small piston driven by a ball screw and stepper motor or other variable control motor, because of the ability to iteratively change the volume of the system. The pump 426 may also be a progressive cavity pump. When using other types of pumps, a flow meter should also be included. A valve 430 for controlling fluid flow to the pump 426 is disposed in the fluid line 422 between a pressure sensor 424 and the pump 426. A test volume 405 is the volume below the retracting piston of the pump 426 and includes the fluid line 422. The pressure sensor is used to sense the pressure within the test volume 404. The sensor 424 is connected to the controller 418 to provide the feedback data required for a closed loop control system. The feedback is used to adjust parameter settings such as a pressure limit for subsequent volume changes. The downhole controller should incorporate a processor (not separately shown) for further reducing test time, and an optional database and storage system could be incorporated to save data for future analysis and for providing default settings.

When drawing down the sealed section 404, fluid is vented to the upper annulus 402 via an equalization valve 419. A conduit 427 connecting the pump 426 to the equalization valve 419 includes a selectable internal valve 432. If fluid sampling is desired, the fluid may be diverted to optional sample reservoirs 428 by using the internal valves 432, 433*a*, and 433*b* rather than venting through the equalization valve 419. For typical fluid sampling, the fluid contained in the reservoirs 428 is retrieved from the well for analysis.

A preferred embodiment for testing low mobility (tight) formations includes at least one pump (not separately shown) in addition to the pump 426 shown. The second pump should have an internal volume much less than the internal volume of the primary pump 426. A suggested volume of the second pump is 1/100 the volume of the primary pump. A typical "T" connector having selection valve controlled by the downhole controller 418 may be used to connect the two pumps to the fluid line 422.

In a tight formation, the primary pump is used for the initial draw down. The controller switches to the second pump for operations below the formation pressure. An advantage of the second pump with a small internal volume is that build-up times are faster than with a pump having a larger volume.

Results of data processed downhole may be sent to the surface in order to provide downhole conditions to a drilling operator or to validate test results. The controller passes processed data to a two-way data communication system 416 disposed downhole. The downhole system 416 transmits a data signal to a surface communication system 412. There are several methods and apparatus known in the art suitable for transmitting data. Any suitable system would suffice for the purposes of this invention. Once the signal is received at the surface, a surface controller and processor 410 converts and transfers the data to a suitable output or storage device 414. As described earlier, the surface controller 410 and surface communication system 412 is also used to send the test initiation command.

Figure 5:
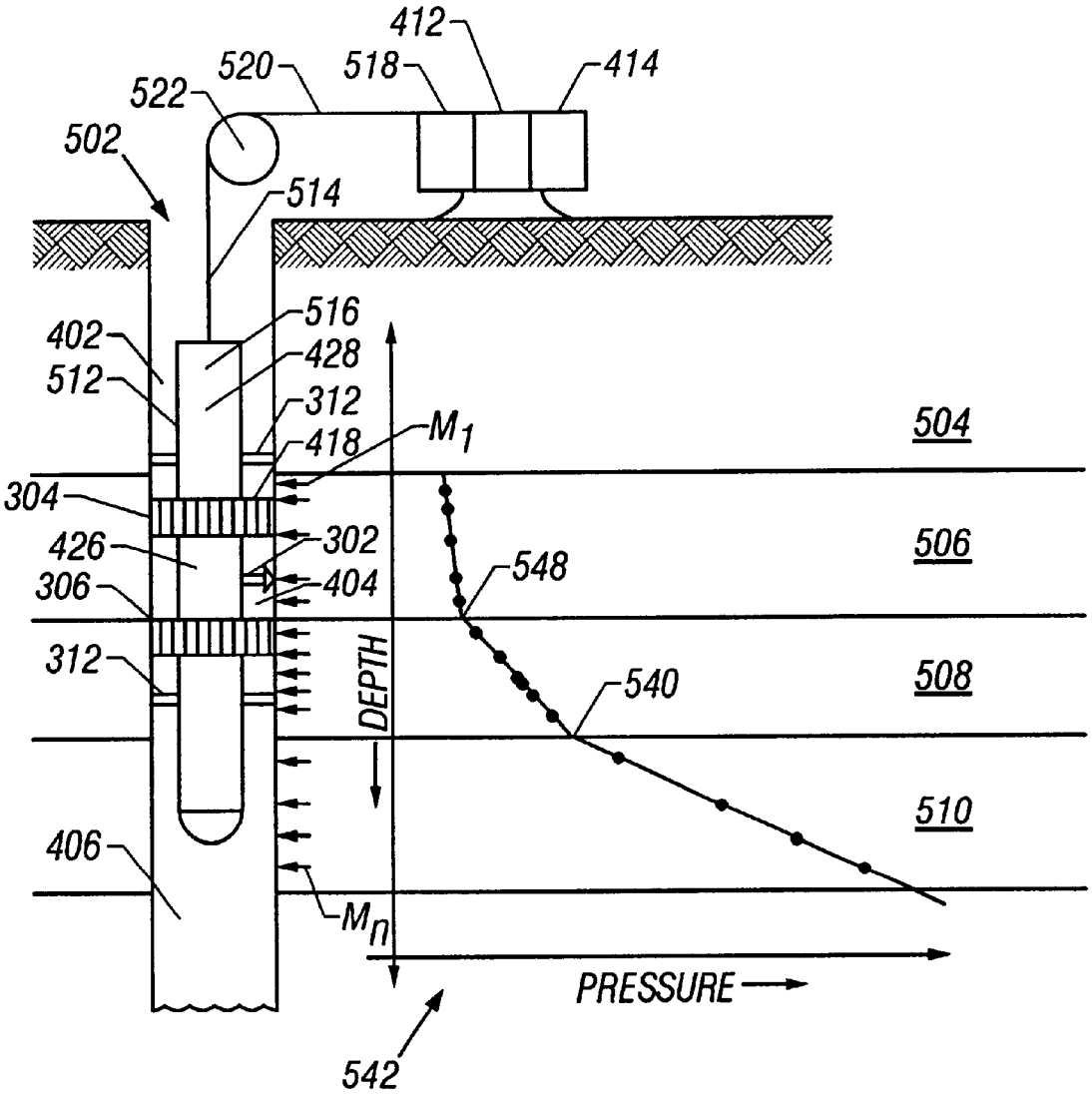
FIG. 5 is an elevation view of a wireline embodiment according to the present invention.

FIG. 5 is a wireline embodiment according to the present invention. A well 502 is shown traversing a formation 504 containing a reservoir having gas 506, oil 508 and water 510 layers. A wireline tool 512 supported by an armored cable 514 is disposed in the well 502 adjacent the formation 504. Extending from the tool 512 are optional grippers 312 for stabilizing the tool 512. Two expandable packers 304 and 306 are disposed on the tool 512 are capable of separating the annulus of the borehole 502 into an upper annulus 402, a sealed intermediate annulus 404 and a lower annulus 406. A selectively extendable pad member 302 is disposed on the tool 512. The grippers 312, packers 304 and 306, and extendable pad element 302 are essentially the same as those described in FIGS. 3 and 4, therefore the detailed descriptions are not repeated here.

Telemetry for the wireline embodiment is a downhole two-way communication unit 516 connected to a surface two-way communication unit 518 by one or more conductors 520 within the armored cable 514. The surface communication unit 518 is housed within a surface controller that includes a processor 412 and output device 414 as described in FIG. 4. A typical cable sheave 522 is used to guide the armored cable 514 into the borehole 502. The tool 512 includes a downhole processor 418 for controlling formation tests in accordance with methods to be described in detail later.

The embodiment shown in FIG. 5 is desirable for determining contact points 548 and 540 between the gas 506 and oil 508 and between the oil 508 and water 510. To illustrate this application a plot 542 of pressure vs. depth is shown superimposed on the formation 504. The downhole tool 512 includes a pump 426, a plurality of sensors 424 and optional sample tanks 428 as described above for the embodiment shown in FIG. 4. These components are used to measure formation pressure at varying depths within the borehole 502. The pressures plotted as shown are indicative of fluid or gas density, which varies distinctly from one fluid to the next. Therefore, having multiple pressure measurements $M_1$–$M_n$ provides data necessary to determine the contact points 548 and 540.

The data taken by the above described exemplary tools is commonly analyzed, as discussed previously, using the general form of a multiple linear regression, for example;

$$y=a_0+a_1 \cdot x_1+a_2 \cdot x_2 \quad (1)$$

and is applied to Eq. (2) as indicated, where Eq. (2) relates the tool pressure p(t) to the formation properties and the flow rate from the formation:

$$\overset{y}{\overline{p(t)}} = \overset{a_0}{\overline{p^*}} - \overset{a_1}{\overline{\frac{\eta}{kG_0r_i}\frac{1}{C}}} \cdot \overset{x_1}{\overline{V \cdot \frac{dp}{dt}}} - \overset{a_2}{\overline{\frac{\eta}{kG_0r_i} \cdot A_{piston}}} \cdot \overset{x_2}{\overline{\frac{dx}{dt}}} \tag{2}$$

Noting that dp/dt, dx/dt, and V are the only non-constant variables on the right hand side of Eq. 2, the multi-linear regression technique can be used to simultaneously obtain two slopes, $a_1$ and $a_2$, and an intercept, $a_0$. From the slope, $a_2$, of the dx/dt term, formation permeability, k, is calculated when the fluid viscosity, η, is known. Alternatively, if formation permeability is known, the fluid viscosity, η, may be determined from the $a_2$ slope. The slope, $a_1$, of the pressure derivative term is used to calculate the system compressibility, C. The compressibility is calculated for every test because it might vary from test to test. This is because C in Eq. 2 is the compressibility of the fluid in the tool, not in the formation, and the fluid content of the tool can quickly change with repeated tests. The intercept, $a_0$, provides an estimate of the formation pressure, p*. Note that the volume, V, is the time dependent system volume calculated from the piston motion, x(t) and the piston area, $A_{piston}$.

When the time series data, p(t) and x(t) from the sampling tool is applied to Eq. 2, a set of equations are generated representing each data set, such as;

Data Set $$\begin{aligned}
&1.\ \overset{y}{\overline{p_1}} = a_0 + a_1\overset{x_1}{\overline{\left(V\left(\frac{dp}{dt}\right)\right)_1}} + a_2\overset{x_2}{\overline{\left(\frac{dx}{dt}\right)_1}} \\
&2.\ p_2 = a_0 + a_1\left(V\left(\frac{dp}{dt}\right)\right)_2 + a_2\left(\frac{dx}{dt}\right)_2 \\
&3.\ p_3 = a_0 + a_1\left(V\left(\frac{dp}{dt}\right)\right)_3 + a_2\left(\frac{dx}{dt}\right)_3 \\
&\quad\vdots \\
&4.\ p_n = a_0 + a_1\left(V\left(\frac{dp}{dt}\right)\right)_n + a_2\left(\frac{dx}{dt}\right)_n
\end{aligned} \tag{3}$$

where, the set of equations are the input to the multiple linear regression. Techniques for performing a multiple linear regression are well known and will not be described here. The regression analysis may be programmed into the surface processor for analysis. Alternatively, the regression technique may be programmed into a downhole processor for downhole control of the sampling process. As will be known to one skilled in the art, it is not necessary to store all the data points in memory and then perform the analysis. Each new data set may be appropriately added to stored intermediate results to minimize the need for downhole stored data.

Figure 1:
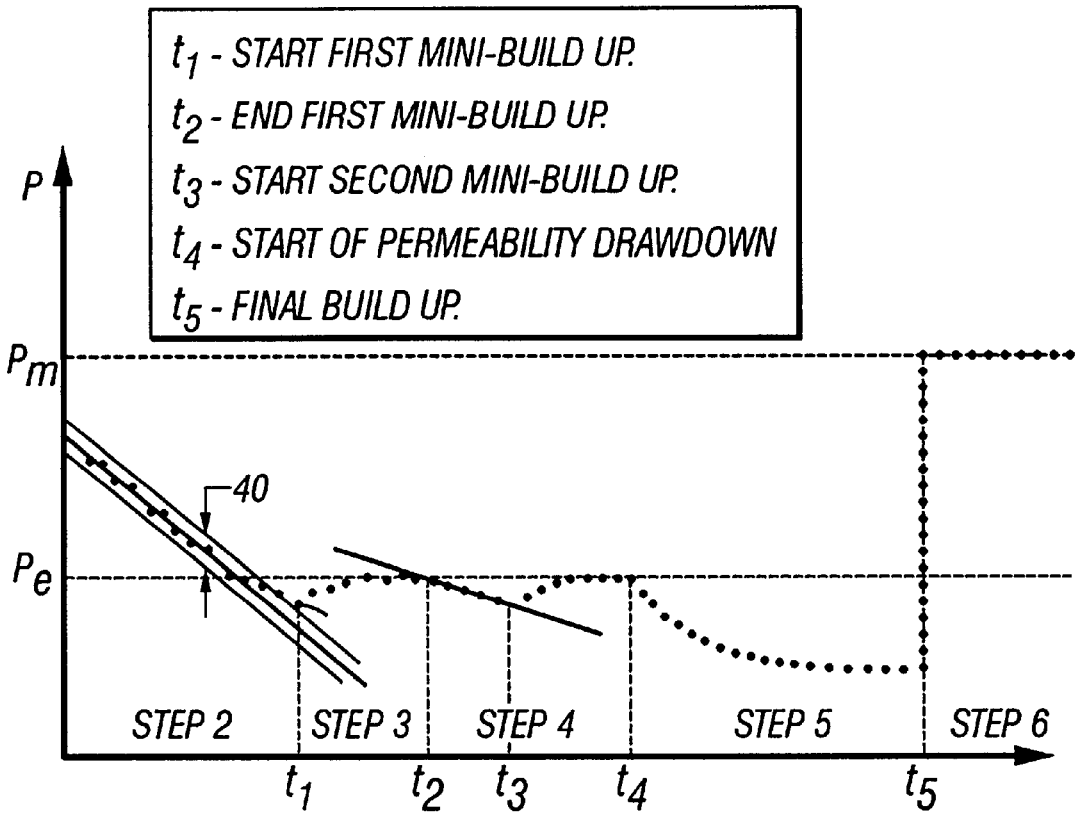
FIG. 1 (Prior Art)
FIG. 1 is a graphical qualitative representation a formation pressure test using a particular prior art method.
Figure 6:
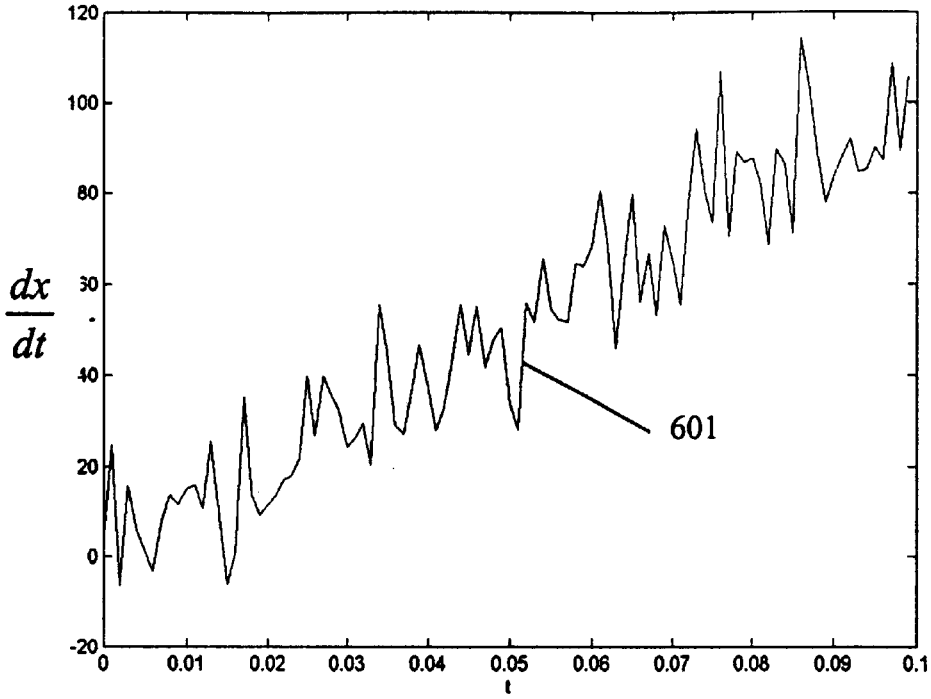
FIG. 6 is a graph showing a typical time derivative of a sample piston position, dx/dt.

Both systematic and statistical errors are common in substantially all measurement systems and result in a certain amount of data scatter from an expected result. Such data scatter, for example, can be seen in Step 2 of FIG. 1 where the data points in a linear physical process are scattered around a best-fit straight line. As is well known, differentiation of such time-series data with scatter exacerbates the problem. FIG. 6 shows the dx/dt result of differentiating the position x(t) with respect to time, where curve 601 shows the plot of dx/dt versus time. Similar results can be expected when differentiating the pressure with respect to time. The increased scatter, or uncertainty, in the derivative terms is propagated through the multiple linear regression techniques resulting in increased uncertainty in the constants $a_0$, $a_1$, and $a_2$ calculated from the multiple linear regression. However, accurate determination of the constants is the goal of the analysis since the formation and fluid properties and pressure are determined from the constants as previously described.

The present invention, as described below, provides a method of smoothing, also known as filtering, the derivative results in order to reduce the uncertainty in the calculated constants and provide better determination of the formation and fluid properties.

The technique is based on the assumption that if the following two equations are true, then the sum of the equations must also be true.

$$\begin{aligned}
\overset{y}{\overline{p_1}} &= a_0 + a_1\overset{x_1}{\overline{\left(V\left(\frac{dp}{dt}\right)\right)_1}} + a_2\overset{x_2}{\overline{\left(\frac{dx}{dt}\right)_1}} \\
p_2 &= a_0 + a_1\left(V\left(\frac{dp}{dt}\right)\right)_2 + a_2\left(\frac{dx}{dt}\right)_2
\end{aligned} \tag{4}$$

Therefore, instead of applying the multiple linear regression as described for equations (3), the following set of equations are used;

#data set (p,x):

$$\begin{aligned}
&1.\ \overset{y}{\overline{p_1}} = a_0 + a_1\overset{x_1}{\overline{\left(V\left(\frac{dp}{dt}\right)\right)_1}} + a_2\overset{x_2}{\overline{\left(\frac{dx}{dt}\right)_1}} \\
&2.\ \overset{y}{\overline{p_1 + p_2}} = \\
&\qquad 2 \cdot a_0 + a_1\overset{x_1}{\overline{\left(\left(V\left(\frac{dp}{dt}\right)\right)_1 + \left(V\left(\frac{dp}{dt}\right)_2\right)\right)}} + a_2\overset{x_2}{\overline{\left(\left(\frac{dx}{dt}\right)_1 + \left(\frac{dx}{dt}\right)_2\right)}} \\
&\qquad\vdots \\
&n.\ \overset{y}{\overline{p_1 + p_2 + \ldots + p_n}} = \\
&\qquad n \cdot a_0 + a_1\overset{x_1}{\overline{\left(\left(V\left(\frac{dp}{dt}\right)\right)_1 + \left(V\left(\frac{dp}{dt}\right)\right)_2 + \ldots + \left(V\left(\frac{dp}{dt}\right)\right)_n\right)}} + \\
&\qquad\qquad a_2\overset{x_2}{\overline{\left(\left(\frac{dx}{dt}\right)_1 + \left(\frac{dx}{dt}\right)_2 + \ldots + \left(\frac{dx}{dt}\right)_n\right)}}
\end{aligned} \tag{5}$$

where the general form of the set of equations (5) is;

$$\sum_{i=1}^{n} y_i = n \cdot a_0 + a_1 \cdot \sum_{i=1}^{n} x_{1,i} + a_2 \cdot \sum_{i=1}^{n} x_{2,i} \tag{6}$$

Figure 7:
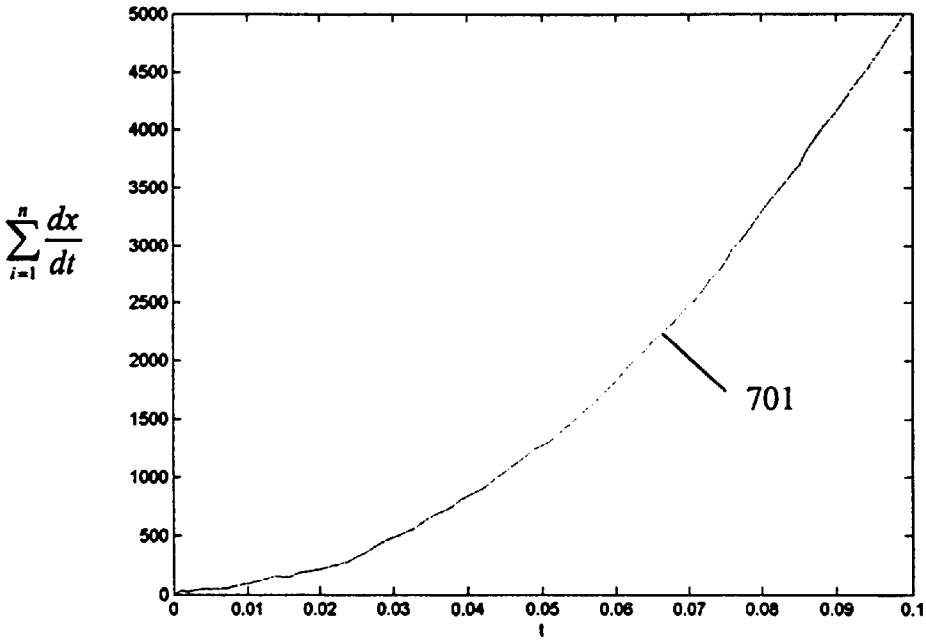
FIG. 7 is a graph showing a plot of a summation smoothed derivative term plotted versus time.

FIG. 7 shows curve 701 that is the $$\sum_{i=1}^{n} \frac{dx}{dt}$$

term plotted versus time. Curve 701 is substantially smoother than the dx/dt term of curve 601 in FIG. 6. A smoother curve leads to a substantially better multiple linear regression with less uncertainty in the coefficients. This leads to a better correlation allowing better predictions of the fluid and formation properties from the pressure and flow data.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

Nomenclature

| | |
|---|---|
| C | compressibility factor, l/psi |
| $G_o$ | geometric factor |
| k | permeability, mD |
| p | pressure, psi |
| $p^*$ | undisturbed formation pressure, psi |
| q | volumetric flowrate, $cm^3/s$ |
| $r_i$ | probe radius, cm |
| t | time, s |
| V | system volume, $cm^3$ |
| $\eta$ | viscosity of fluid, cp |
| x | draw down piston displacement, cm |
| $A_{piston}$ | draw down piston area, $cm^2$ |

What is claimed is:

1. A method of determining at least one formation parameter of interest, comprising;

a. sampling fluid from a formation using a tool having a sample chamber and a fluid sampling device;

b. determining time dependent pressure in a corresponding time dependent tool volume;

c. determining a corresponding draw rate of the formation fluid as a function of time; and d. using a sum of said tool volume pressure, a sum of a time derivative of said tool volume pressure, and a sum of said draw rate as input data for a regression analysis wherein, the output of the regression analysis represents the at least one formation parameter of interest.

2. The method of claim 1 wherein, the at least one parameter of interest is selected from a group consisting of (i) formation permeability, (ii) fluid compressibility, (iii) fluid viscosity, and (iv) formation pressure.

3. The method of claim 1 wherein, the draw rate is related to the movement of a piston in the sample chamber.

4. The method of claim 1 wherein, the draw rate is related to the output of at least one positive displacement pump.

5. The method of claim 1 wherein, the regression analysis is a multiple linear regression analysis relating said tool pressure to a first term related to the time derivative of pressure and a second term related to the time derivative of volume, said regression determining an intercept term, a first slope term associated with said first term, and a second slope term associated with said second term.

6. The method of claim 5 wherein said formation permeability is determined from said second slope term.

7. The method of claim 5 wherein said fluid compressibility is determined from said first slope term.

8. The method of claim 5 wherein said formation pressure is determined from said intercept term.

9. A method for determining at least one parameter of interest of a formation surrounding a borehole, the method comprising:

a. conveying a tool into a borehole, the borehole traversing a subterranean formation containing formation fluid under pressure;

b. extending a probe from said tool to said formation establishing hydraulic communication between said formation and a volume of a chamber in said tool;

c. withdrawing fluid from said formation by increasing the volume of the chamber in said tool with a volume control device;

d. measuring a pressure of said fluid and the corresponding volume of said chamber as a function of time at a plurality of times generating a data set of pressure and volume at each of said plurality of times;

e. calculating corresponding time derivatives of said measured pressure and said measured volume for each of said plurality of times;

f. generating a set of equations comprising a multiple linear equation for each data set relating said measured pressure to a first term related to the time derivative of pressure and a second term related to the time derivative of volume, where, for each data set; said measured pressure comprises said corresponding measured pressure added to the sum of measured pressure of all preceding data sets; said first term comprises said corresponding time derivative of pressure added to the sum of time derivatives of pressure of all preceding data sets; and said second term comprises said corresponding time derivative of volume added to the sum of time derivatives of volume of all preceding data sets; and g. performing a multiple linear regression on said set of equations determining an intercept term, a first slope term associated with said first term, and a second slope term associated with said second term.

10. The method of claim 9 wherein the at least one parameter of interest is selected from a group consisting of (i) formation permeability, (ii) fluid compressibility, (iii) fluid viscosity, and (iv) formation pressure.

11. The method of claim 10 wherein said formation permeability is determined from said second slope term.

12. The method of claim 10 wherein said fluid compressibility is determined from said first slope term.

13. The method of claim 10 wherein said formation pressure is determined from said intercept term.

14. The method of claim 9 wherein the volume control device comprises at least one pump.

15. The method of claim 9 wherein the volume control device comprises a movable piston.

16. The method of claim 14 wherein the at least one pump is a positive displacement pump.

* * * * *